US005691027A

United States Patent [19]

Eckhardt et al.

[11] Patent Number: 5,691,027

[45] Date of Patent: Nov. 25, 1997

[54] FASTENER WITH A DUAL PURPOSE COVER SHEET

[75] Inventors: Carey J. Eckhardt, Mounds View; Bradley D. Zinke, Woodbury, both of Minn.

[73] Assignee: Minnesota Mining and Manufacturing Company, St. Paul, Minn.

[21] Appl. No.: 536,192

[22] Filed: Sep. 29, 1995

Related U.S. Application Data

[63] Continuation of Ser. No. 97,984, Jul. 27, 1993, abandoned.

[51] Int. Cl.[6] ..... B32B 3/06

[52] U.S. Cl. ..... 428/100; 24/306; 24/442; 24/448; 24/450; 428/40.1; 428/41.7; 428/41.8; 428/86; 428/99; 428/101; 428/352; 428/354; 428/906

[58] Field of Search ..... 428/86, 100, 99, 428/101, 37, 906, 40, 42, 343, 352, 354; 24/306, 442, 448, 450

[56] References Cited

U.S. PATENT DOCUMENTS

| | | | |
|---|---|---|---|
| 2,532,011 | 11/1950 | Dahlquist et al. | 154/53.5 |
| 2,717,437 | 9/1955 | De Mestral | 28/72 |
| 3,009,235 | 11/1961 | Mestral | 28/78 |
| 3,027,595 | 4/1962 | Takai et al. | 18/10 |
| 3,138,841 | 6/1964 | Naimer | 24/204 |
| 3,147,528 | 9/1964 | Erb | 24/204 |
| 3,192,589 | 7/1965 | Pearson | 24/204 |
| 3,235,438 | 2/1966 | Wisotzky | 161/62 |
| 3,270,408 | 9/1966 | Nealis | 29/408 |
| 3,312,583 | 4/1967 | Rochlis | 161/62 |
| 3,320,649 | 5/1967 | Naimer | 28/72 |
| 3,353,663 | 11/1967 | Kayser et al. | 206/59 |
| 3,408,705 | 11/1968 | Kayser et al. | 24/204 |
| 3,413,678 | 12/1968 | Krantz | 428/100 |
| 3,490,107 | 1/1970 | Brumlik | 24/204 |

(List continued on next page.)

FOREIGN PATENT DOCUMENTS

| | | |
|---|---|---|
| 0 043 714 A1 | 1/1982 | European Pat. Off. . |
| 0 062 738 | 2/1982 | European Pat. Off. . |
| 0 093 008 A2 | 11/1983 | European Pat. Off. . |
| 0 109 941 A1 | 5/1984 | European Pat. Off. . |
| 0 211 564 A3 | 2/1987 | European Pat. Off. . |
| 0 288 393 | 4/1988 | European Pat. Off. . |
| 0 270 888 A2 | 6/1988 | European Pat. Off. . |
| 0 276 970 A2 | 8/1988 | European Pat. Off. . |
| 0 278 866 A1 | 8/1988 | European Pat. Off. . |
| 0 319 249 A1 | 6/1989 | European Pat. Off. . |
| 0 325 528 A1 | 7/1989 | European Pat. Off. . |
| 1383501 | 11/1964 | France . |
| 1513722 | 1/1968 | France . |
| 2101195 | 3/1972 | France . |
| 2149959 | 3/1973 | France . |
| 2150196 | 3/1973 | France . |
| 2220216 | 10/1974 | France . |
| 2 328 432 | 5/1977 | France . |
| 2 352 524 | 12/1977 | France . |
| 2 364 004 | 4/1978 | France . |
| 2 368 587 | 5/1978 | France . |
| 2 377 498 | 8/1978 | France . |

(List continued on next page.)

OTHER PUBLICATIONS

Dominick V. Rosato, PE and Donald V. Rosato, PhD (eds), *Injection Molding Handbook*, pp. 504–506, 596, 619–621, 752–754, and 756; Van Nostrand Reinhold Company, New York, 1986.

*Primary Examiner*—Nasser Ahmad

*Attorney, Agent, or Firm*—Gary L. Griswold; Walter N. Kirn; Charles D. Levine

[57] ABSTRACT

The invention relates to a fastener member having a dual purpose cover sheet. The fastener member includes a base sheet, a plurality of engaging members projecting from the base sheet, a layer of pressure sensitive adhesive on an opposite surface of a base sheet, and a dual purpose cover sheet. The dual purpose cover sheet protects the adhesive layer of a first fastener member, and the engaging members of a second, underlying fastener member.

19 Claims, 4 Drawing Sheets

U.S. PATENT DOCUMENTS

| | | | |
|---|---|---|---|
| 3,494,006 | 2/1970 | Brumlik | 24/204 |
| 3,522,637 | 8/1970 | Brumlik | 24/204 |
| 3,555,601 | 1/1971 | Price | 18/10 |
| 3,583,057 | 6/1971 | Kolozsvary | 29/270 |
| 3,594,863 | 7/1971 | Erb | 18/5 |
| 3,594,865 | 7/1971 | Erb | 18/5 |
| 3,600,261 | 8/1971 | Kerres | 161/64 |
| 3,660,191 | 5/1972 | Shimota et al. | 156/304.4 |
| 3,708,833 | 1/1973 | Ribich et al. | 24/204 |
| 3,711,349 | 1/1973 | Snyder et al. | 156/157 |
| 3,718,725 | 2/1973 | Hamano | 264/163 |
| 3,762,000 | 10/1973 | Menzin et al. | 24/204 |
| 3,773,580 | 11/1973 | Provost | 156/66 |
| 3,780,479 | 12/1973 | Billarant et al. | 52/222 |
| 3,817,015 | 6/1974 | Frangos | 428/100 |
| 3,849,840 | 11/1974 | Yamada et al. | 24/204 |
| 3,858,269 | 1/1975 | Sutton et al. | 16/16 |
| 3,863,304 | 2/1975 | Brumlik | 24/204 |
| 3,866,267 | 2/1975 | Poletti | 428/86 |
| 3,913,183 | 10/1975 | Brumlik | 24/204 |
| 4,012,544 | 3/1977 | Richards | 428/100 |
| 4,024,003 | 5/1977 | Bühler | 156/148 |
| 4,041,667 | 8/1977 | Lindner et al. | 52/483 |
| 4,056,593 | 11/1977 | de Navas Albareda . | |
| 4,090,335 | 5/1978 | Curatolo | 52/239 |
| 4,114,346 | 9/1978 | Kelly | 52/746 |
| 4,169,303 | 10/1979 | Lemelson | 24/204 |
| 4,216,257 | 8/1980 | Schams et al. | 428/93 |
| 4,263,755 | 4/1981 | Globus | 51/358 |
| 4,290,174 | 9/1981 | Kalleberg | 24/204 |
| 4,290,832 | 9/1981 | Kalleberg | 156/72 |
| 4,315,885 | 2/1982 | Lemelson | 264/297 |
| 4,322,875 | 4/1982 | Brown et al. | 24/204 |
| 4,336,289 | 6/1982 | Davis | 428/67 |
| 4,350,721 | 9/1982 | Nagase | 428/33 |
| 4,361,610 | 11/1982 | Roth | 428/95 |
| 4,405,668 | 9/1983 | Wald | 428/40 |
| 4,410,327 | 10/1983 | Baggaley | 604/391 |
| 4,437,269 | 3/1984 | Shaw | 51/358 |
| 4,454,183 | 6/1984 | Wollman | 428/92 |
| 4,531,634 | 7/1985 | Jung-Chi | 206/391 |
| 4,536,244 | 8/1985 | Greci et al. | 156/304.4 |
| 4,557,774 | 12/1985 | Hoopengardner | 156/71 |
| 4,563,380 | 1/1986 | Black et al. | 428/100 |
| 4,581,269 | 4/1986 | Tilman | 428/62 |
| 4,581,274 | 4/1986 | Johns et al. | 428/95 |
| 4,635,418 | 1/1987 | Hobgood | 52/239 |
| 4,647,484 | 3/1987 | Higgins | 428/40 |
| 4,653,582 | 3/1987 | Ehrenfried | 24/442 |
| 4,665,909 | 5/1987 | Trainor | 128/155 |
| 4,671,976 | 6/1987 | Vidal | 428/40 |
| 4,673,603 | 6/1987 | Roth | 428/100 |
| 4,699,622 | 10/1987 | Toussant et al. | 604/389 |
| 4,706,914 | 11/1987 | Ground | 248/74.3 |
| 4,707,893 | 11/1987 | Hashizume et al. | 24/446 |
| 4,710,414 | 12/1987 | Northrup et al. | 428/43 |
| 4,716,065 | 12/1987 | McLaughlin | 428/100 |
| 4,755,401 | 7/1988 | Friedrich et al. | 428/100 |
| 4,758,457 | 7/1988 | Altus | 428/82 |
| 4,761,318 | 8/1988 | Ott et al. | 428/85 |
| 4,769,895 | 9/1988 | Parkins | 29/450 |
| 4,775,310 | 10/1988 | Fischer | 425/308 |
| 4,784,890 | 11/1988 | Black | 428/100 |
| 4,810,546 | 3/1989 | McLaughlin | 428/62 |
| 4,814,036 | 3/1989 | Hatch | 156/245 |
| 4,819,309 | 4/1989 | Behymer | 24/576 |
| 4,822,658 | 4/1989 | Pacione | 428/95 |
| 4,824,498 | 4/1989 | Goodwin et al. | 156/71 |
| 4,857,371 | 8/1989 | McClintock | 428/36.5 |
| 4,870,725 | 10/1989 | Dubowik | 24/442 |
| 4,872,243 | 10/1989 | Fischer | 24/442 |
| 4,875,259 | 10/1989 | Appeldorn | 24/576 |
| 4,881,997 | 11/1989 | Hatch | 156/66 |
| 4,894,060 | 1/1990 | Nestegard | 604/391 |
| 4,897,891 | 2/1990 | Kallman et al. | 5/493 |
| 4,909,883 | 3/1990 | Adell | 156/247 |
| 4,910,062 | 3/1990 | Zinke et al. | 428/95 |
| 4,921,742 | 5/1990 | Altus | 428/81 |
| 4,931,343 | 6/1990 | Becker et al. | 428/95 |
| 4,933,224 | 6/1990 | Hatch | 428/100 |
| 4,959,265 | 9/1990 | Wood et al. | 428/343 |
| 4,974,384 | 12/1990 | Pacione | 52/483 |
| 5,032,122 | 7/1991 | Noel et al. | 604/391 |
| 5,040,275 | 8/1991 | Eckhardt et al. | 24/447 |
| 5,042,221 | 8/1991 | Pacione | 52/749 |
| 5,056,933 | 10/1991 | Kamp | 383/63 |
| 5,058,247 | 10/1991 | Thomas et al. | 24/448 |
| 5,060,443 | 10/1991 | Pacione | 52/506 |
| 5,066,444 | 11/1991 | Behr | 264/171 |
| 5,067,210 | 11/1991 | Kayaki | 24/452 |
| 5,067,822 | 11/1991 | Wirth et al. | 383/61 |
| 5,077,870 | 1/1992 | Melbye et al. | 24/452 |
| 5,088,164 | 2/1992 | Wilson et al. | 24/576 |
| 5,100,400 | 3/1992 | Mody et al. | 604/391 |
| 5,110,649 | 5/1992 | Morse et al. | 428/100 |
| 5,116,563 | 5/1992 | Thomas et al. | 264/167 |
| 5,133,166 | 7/1992 | Pacione | 52/483 |
| 5,135,909 | 8/1992 | Stephens et al. | 507/121 |
| 5,138,750 | 8/1992 | Gundlach et al. | 24/587 |
| 5,144,786 | 9/1992 | Pacione | 52/747 |
| 5,149,573 | 9/1992 | Kobe et al. | 428/93 |
| 5,180,618 | 1/1993 | Kessler et al. | 428/100 |
| 5,181,461 | 1/1993 | Viaud | 100/88 |
| 5,191,692 | 3/1993 | Pacione | 29/423 |
| 5,196,266 | 3/1993 | Lu et al. | 428/355 |
| 5,201,101 | 4/1993 | Rouser et al. | 24/575 |
| 5,204,155 | 4/1993 | Bell et al. | 428/95 |
| 5,230,851 | 7/1993 | Thomas | 264/145 |
| 5,242,646 | 9/1993 | Torigoe et al. | 264/219 |
| 5,286,431 | 2/1994 | Banfield et al. | 264/134 |
| 5,318,741 | 6/1994 | Thomas | 264/519 |
| 5,354,591 | 10/1994 | Ott et al. | 428/99 |
| 5,382,462 | 1/1995 | Pacione | 428/95 |

FOREIGN PATENT DOCUMENTS

| | | |
|---|---|---|
| 7029524 | 11/1970 | Germany . |
| 2 201 231 | 7/1973 | Germany . |
| 25 53 979 B2 | 6/1976 | Germany . |
| 26 47 113 | 5/1977 | Germany . |
| 28 03 006 A1 | 8/1979 | Germany . |
| 32 44 410 A1 | 10/1983 | Germany . |
| 48-88732 | 11/1973 | Japan . |
| 49-34519 | 3/1974 | Japan . |
| 50-127222 | 10/1975 | Japan . |
| 51-18129 | 2/1976 | Japan . |
| 51-43827 | 4/1976 | Japan . |
| 52-56725 | 5/1977 | Japan . |
| 52-139229 | 11/1977 | Japan . |
| 53-62332 | 6/1978 | Japan . |
| 53-74719 | 7/1978 | Japan . |
| 53-74720 | 7/1978 | Japan . |
| 54-10525 | 1/1979 | Japan . |
| 54-3341 | 1/1979 | Japan . |
| 54-136725 | 10/1979 | Japan . |
| 54-149228 | 11/1979 | Japan . |
| 55-81618 | 6/1980 | Japan . |
| 55-99223 | 7/1980 | Japan . |
| 55-136303 | 10/1980 | Japan . |
| 56-18817 | 2/1981 | Japan . |
| 56-60514 | 5/1981 | Japan . |
| 56-70723 | 6/1981 | Japan . |
| 57-20280 | 2/1982 | Japan . |

| | | |
|---|---|---|
| 57-64016 | 4/1982 | Japan . |
| 57-122815 | 7/1982 | Japan . |
| 58-54914 | 4/1983 | Japan . |
| 58-58019 | 4/1983 | Japan . |
| 58-149712 | 9/1983 | Japan . |
| 59-15156 | 1/1984 | Japan . |
| 59-44216 | 3/1984 | Japan . |
| 59-108576 | 6/1984 | Japan . |
| 59-137180 | 9/1984 | Japan . |
| 60-106410 | 6/1985 | Japan . |
| 60-132575 | 7/1985 | Japan . |
| 60-156417 | 8/1985 | Japan . |
| 60-175603 | 9/1985 | Japan . |
| 61-68012 | 4/1986 | Japan . |
| 61-168307 | 7/1986 | Japan . |
| 61-215766 | 9/1986 | Japan . |
| 61-255607 | 11/1986 | Japan . |
| 63-107241 | 7/1988 | Japan . |
| 339155 | 8/1959 | Switzerland . |
| 527 594 | 10/1972 | Switzerland . |
| 1199940 | 7/1970 | United Kingdom . |
| 1 204 886 | 9/1970 | United Kingdom . |
| 1205267 | 9/1970 | United Kingdom . |
| 1 341 817 | 12/1973 | United Kingdom . |
| 1 376 262 | 12/1974 | United Kingdom . |
| 1 472 729 | 4/1977 | United Kingdom . |
| 1 546 901 | 5/1979 | United Kingdom . |
| 1 573 492 | 8/1980 | United Kingdom . |
| 2 111 106 | 6/1983 | United Kingdom . |
| 2 142 842 | 1/1985 | United Kingdom . |
| WO 86/01247 | 2/1986 | WIPO . |
| WO 86/03164 | 6/1986 | WIPO . |
| WO 87/06522 | 5/1987 | WIPO . |
| WO 92/01401 | 2/1992 | WIPO . |
| WO 93/03644 | 3/1993 | WIPO . |
| WO 94/23609 | 10/1994 | WIPO . |
| WO 94/23610 | 10/1994 | WIPO . |

FASTENER WITH A DUAL PURPOSE COVER SHEET

This is a continuation of application Ser. No. 08/097,984 filed Jul. 27, 1993 now abandoned.

TECHNICAL FIELD

The invention relates to fastener member having a dual purpose cover sheet.

BACKGROUND OF THE INVENTION

Interengaging and intermeshing fastener members are useful in a variety of fields for fastening two objects together. For example, hook and loop fasteners typically include a first fastener member having a base sheet and a plurality of hook members projecting therefrom, and a second fastener member having a base sheet and a plurality of loop members projecting therefrom. When engaged, the hook members catch the loop members to secure the two fastener members together. For purposes of the present invention, a fastener consists of two fastener members, which may or may not be identical. For example, a hook and loop fastener includes a hook fastener member and a loop fastener member.

Exemplary of other fasteners of a similar type are those shown in U.S. Pat. Nos. 3,009,235, 4,454,183, 4,761,318, 4,775,310, 4,894,060, and 5,058,247, which generally disclose a first fastener member having a base sheet and a plurality of headed stems, and a second fastener member having a base sheet and a plurality of loop members. The respective fastener members are secured together in much the same way as hook and loop fasteners, whereby the headed stems engage or catch the loop members to interengage the two fastener members.

Fasteners of the type described above are often most useful when each fastener member is attached to a surface of an object, so that the two objects may be joined together by engaging the respective fastener members. Examples of such applications include fasteners for securing two portions of an article of clothing together, or for securing a piece of trim to a surface. One popular method of attaching the respective fastener members to a surface is to provide a layer of pressure sensitive adhesive on the base sheet, such that the fastener member may be adhered to the surface of the object by the pressure sensitive adhesive. FIG. 1 illustrates such a conventional construction.

As shown in FIG. 1, a fastener member 10 includes a base sheet 12 and a plurality of engaging members 14 (in the form of hooks) that project from the base sheet. Disposed on an opposite major surface of the base sheet 12 is a layer of pressure sensitive adhesive 16, which typically includes a release liner 18 to protect adhesive layer 16 prior to application of the fastener member 10 to a surface. To apply the fastener member 10 to a surface of an object, release liner 18 may be peeled away from the base sheet to expose the adhesive layer 16.

A cover sheet is also provided to prevent the engaging members from contacting and engaging with a surface unintentionally. For example, hook members have a tendency to engage with fabrics and textile materials, and thus a fastener member including hook members may unintentionally become attached to clothing or other fabric prior to use, which is undesirable. A cover sheet 20, shown in FIG. 1, covers the engaging members 14 and thus aids in preventing unintentional engagement of the engaging members with a surface prior to use. Thus, both the cover sheet 20 and the release liner 18 must be removed before the fastener member may be used.

A fastener of the foregoing construction has been used in the field of carpet application. Specifically, a fastener member may be used to anchor carpet to a floor near a wall, or along a seam between adjacent sections of carpet. Loop-like textile structures are provided on the back of the carpet, and engaging members are provided on the fastener member to engage the loop-like structures and affix the carpet to the floor.

An example of a fastener used in conjunction with carpet is shown in FIGS. 2A through 2D. Fastener member 10 may be applied to a surface, such as a floor 30, by removing the release liner 18 and pressing the adhesive layer 16 into contact with the floor. Cover sheet 20 is typically left attached to the engaging members 14 while the carpet is being positioned and cut to size. Cover sheet 20 thus prevents unintentional engagement between the fastener member and the carpet while the carpet is being manipulated in the vicinity of the fastener member. Furthermore, the engaging members are protected from contamination or damage due to exposure to people, dust, paint, fabrics, and the like. When the carpet 32 has been cut and fit into place, cover sheet 20 may be peeled away from fastener 10, allowing loop structures 34 of carpet 32 to engage the engaging members 14. Such a fastening arrangement, in addition to affixing the carpet to the floor, also allows the carpet to be peeled away from the fastener member for cleaning or replacement.

Although the fastener product described above is widely used, it would be desirable to reduce material costs inherent in the product. Furthermore, because both the release liner and the cover strip must both be removed prior to the application of the fastener member, the application process can be relatively time consuming, and therefore expensive. It is also desirable to reduce waste associated with all products that are used by consumers. In view of these concerns, it is desirable to provide an inexpensive fastener member that is useful for applications such as those described above.

SUMMARY OF THE INVENTION

A fastener arrangement is disclosed, comprising a first fastener member, including a base sheet having a first major surface, and a plurality of engaging members attached to and projecting from the first major surface. The arrangement also includes a dual purpose cover sheet having first and second major surfaces, the first major surface including means for releasable affixation to the engaging members of the first fastener member, to affix the cover sheet to the first fastener member, and a second fastener member overlying the first fastener member. The second fastener member includes a base sheet having first and second major surfaces, a multiplicity of engaging members attached to and projecting from the first major surface, and a layer of pressure sensitive adhesive disposed on the second major surface of said base sheet. The layer of pressure sensitive adhesive releasably affixes the second fastener member to the second major surface of said cover sheet. In one embodiment, the first and second fastener members and the cover sheet are wound on core, and the first and second fastener members are spaced portions of a unitary, longitudinally extending fastener member.

Also provided is a method of providing a fastener arrangement. The method comprises the steps of providing a first fastener member, including a base sheet having first and second major surfaces, and a plurality of engaging members attached to and projecting from the first major surface; providing a dual purpose cover sheet having first and second major surfaces; releasably affixing the first major surface of the cover sheet to the engaging members of the first fastener member; providing a second fastener member, including a base sheet having first and second major surfaces, a plurality of engaging members attached to and projecting from the first major surface, and a layer of pressure sensitive adhesive disposed on the second major surface; and releasably affixing the pressure sensitive adhesive layer of the second fastener member to the second major surface of the cover sheet.

In another aspect the invention includes within its scope a method of applying a fastener member to a surface, comprising the steps of providing a fastener arrangement including a fastener member including a base sheet having first and second major surfaces, a plurality of engaging members attached to and projecting from the first major surface, and a layer of pressure sensitive adhesive disposed on the second major surface, a dual purpose cover sheet having first and second major surfaces, the first major surface including means for releasable affixation to the engaging members of the fastener member, and a core on which the fastener member and dual purpose cover sheet are wound, wherein the pressure sensitive adhesive layer of the fastener member is releasably applied to the core, and the cover sheet is releasably affixed to the engaging members, and the fastener member and the cover sheet are wound onto the core so that layers of the fastener member alternate with layers of the cover sheet; withdrawing from the core a length of the fastener member with the cover sheet attached to the engaging members thereof, such that the adhesive layer releases from the cover sheet attached to an underlying layer of the fastener member; applying the length of fastener member to the surface by contacting the pressure sensitive adhesive layer to the surface; and removing the cover sheet from the engaging members of the length of fastener member.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

The present invention relates broadly to a fastener member having a dual purpose cover sheet. The dual purpose cover sheet functions both to be releasably affixed to the engaging members of a first fastener member, and to be releasably affixed to a pressure sensitive adhesive layer of a second, overlying fastener member. Thus, the single cover sheet of the present invention replaces the cover sheet and release liner of the prior art, with a concomitant savings in time, cost, and waste.

Figure 1:
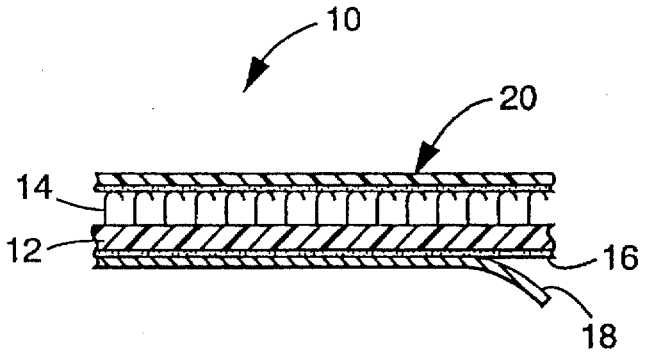
Fig. 1 PRIOR ART
FIG. 1 is a sectional view of a fastener member having a cover sheet and a release liner according to the prior art.
Figure 2A:
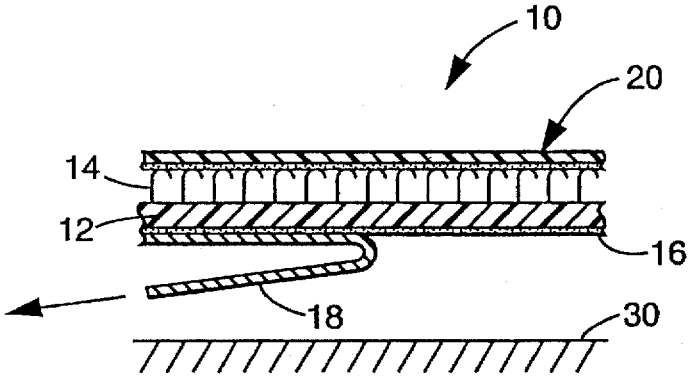
Fig. 2A PRIOR ART
FIGS. 2A through 2D are sectional views of sequential steps in the process of applying a conventional fastener member to a surface.
Figure 2B:
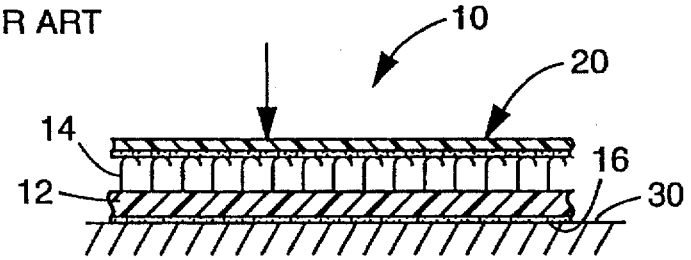
Fig. 2B PRIOR ART
Figure 2C:
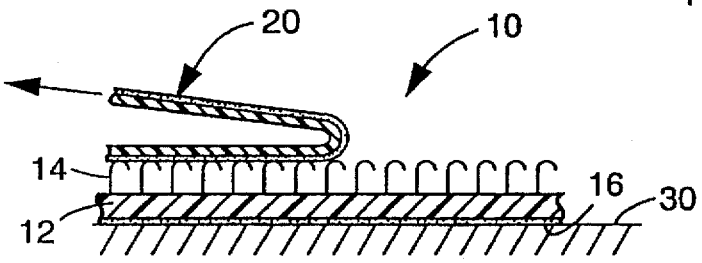
Fig. 2C PRIOR ART
Figure 2D:
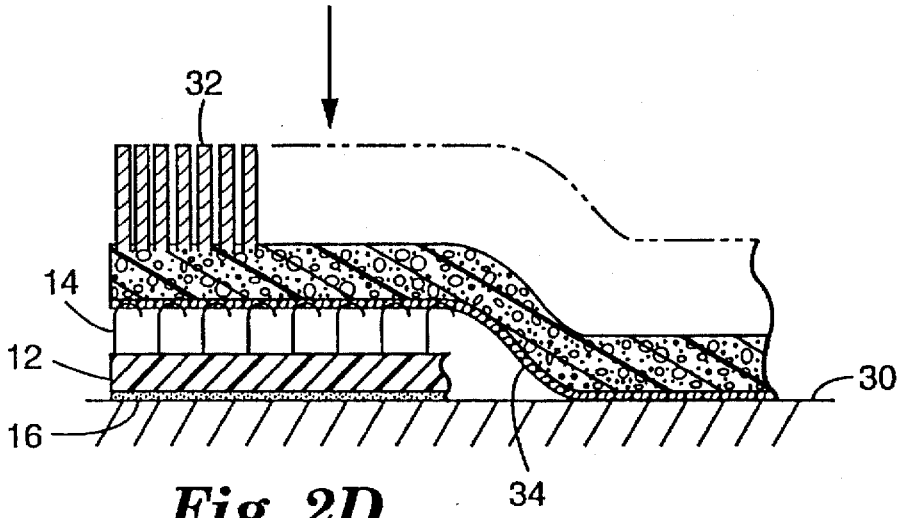
Fig. 2D PRIOR ART
Figure 3:
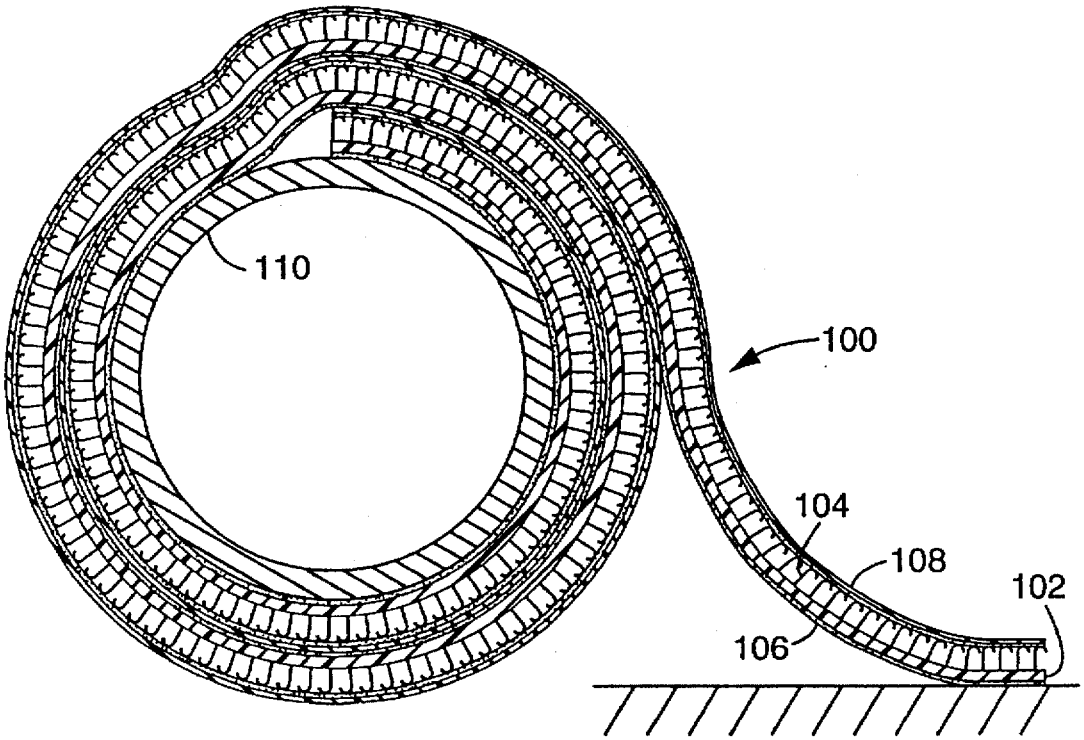
FIG. 3 is a sectional view of a fastener arrangement including a fastener member having a dual purpose cover sheet according to the present invention.

A preferred embodiment of the invention is illustrated in FIG. 3. Fastener member 100 is provided, including a base sheet 102, a plurality of engaging members 104, a layer of pressure sensitive adhesive 106, and a dual purpose cover sheet 108. Each of the various components will be described individually, followed by a description of the overall structure and operation of the present invention. The numeric ranges for various values provided herein are intended only to be illustrative, rather than limiting, of the present invention.

Base Sheet: The base sheet may be made from any suitable material and in any suitable size. For example, the base sheet may be made of polymer (e.g. polyethylene, polypropylene, polyester, nylon, or rubber), textile materials (e.g. cotton), or metal. The base sheet may be extruded, woven, knitted, stitched, or made of a nonwoven or other material, and may be made of two or more of these and other materials (e.g. a laminate, or a blend). The thickness of such a base sheet is preferably between 0.127 and 3.810 mm (0.005 and 0.150 in). The width of the base sheet may be selected as desired, and widths in the range of 0.635 to 365 cm (0.250 to 144 in) can be used.

Figure 8:
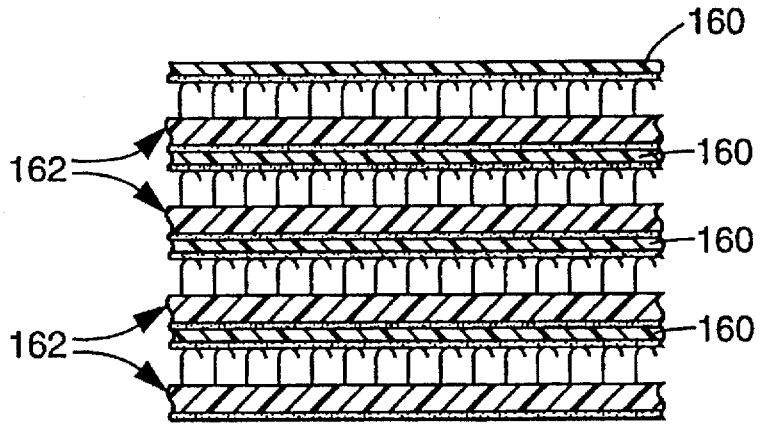
FIG. 8 is a sectional view of an alternate fastener arrangement according to the present invention.

The dimensions and material for the base sheet are preferably selected so that the base sheet is flexible, to facilitate attachment of the fastener member to uneven surfaces. Furthermore, a fastener member having a flexible base sheet may be coiled around a core 110 to form a roll. However, rigid base sheets may also have applicability in the context of the invention in, for example, a stack of individual fastener members, as shown in FIG. 8.

The base sheet performs at least two functions. First, the base sheet must hold the engaging members in place, so that the engaging members are not detached from the base sheet when the attached fastener members are separated from each other. Second, the base sheet must provide a surface for receipt of the layer of pressure sensitive adhesive. This surface may be smooth, striated, knurled, wavy or of any other suitable topographical design.

Engaging Members: The engaging members of the present invention may be one or more of many different types of such members. For example, the engaging members may comprise hook portions, loop portions, structured surfaces, headed stems, woven or nonwoven fibers, or any other suitable structures. Hook portions and loop portions such as those disclosed in U.S. Pat. Nos. 3,009,235, 4,761,318, 4,775,310, 4,894,060, and 5,067,210, the contents of each of which is hereby incorporated by reference, may have utility in this regard. Similarly, structured surfaces such as those disclosed in U.S. Pat. Nos. 4,875,259, 5,088,164, and 5,196,266, the contents of each of which is hereby incorporated by reference, are exemplary, and may be useful in the context of the present invention. Headed stems are disclosed in patents such as U.S. Pat. Nos. 3,138,841, 4,290,174, and 4,454,183, the contents of each of which is hereby incorporated by reference, and also may have utility in conjunction with the present invention. Other suitable engaging members are also contemplated.

The various engaging members are attached to, bonded to, or formed from the base sheet, and should be suitable for engaging an opposed fastener member, as described previously. The opposed fastener may be identical to or different from the subject fastener member, depending on the relative configurations and performance characteristics of each.

Adhesive Layer: The adhesive layer is disposed on the major surface of the base sheet opposite the engaging members. Adhesives that may be useful as the adhesive layer in the present invention include pressure sensitive and non-pressure sensitive adhesives. The former class of adhesives are preferred, and are normally tacky at room temperature, and can be adhered to a surface by the application of light finger pressure. The latter class of adhesives include those that are solvent, heat, or radiation activated. The adhesives may be based on, for example, general compositions of polyacrylate, polyvinyl ether, rubber (e.g. natural rubber), isoprene, polychloroprene, butyl rubber, polyisobutylene, butadiene-acrylonitrile polymer, thermoplastic elastomer, styrenebutadiene polymer, poly-alpha-olefin, amorphous polyolefin, silicone, ethylene-containing copolymer (e.g. ethylene vinyl acetate, ethylene ethyl acrylate, ethylene n-butyl acrylate, and ethylene methyl acrylate), polyurethane, polyamide, epoxy, polyvinylpyrrolidone and polyvinylpyrrolidone copolymers, polyesters, and mixtures or copolymers of the foregoing. The adhesive layer may also contain, for example, tackifiers, plasticizers, fillers, antioxidants, stabilizers, pigments, curatives, crosslinkers, solvents, and the like.

The thickness of the layer of pressure sensitive adhesive may be selected as desired. Thicknesses in the range of 0.0025 to 0.102 cm (0.001 to 0.040 in) have been shown to have utility in the context of the present invention, although other adhesive layer thicknesses may also be used for certain applications. The adhesive layer may be applied to the base sheet as known in the art. For example, the adhesive may be applied to the base sheet by solvent coating, extrusion (either separately from or simultaneously with the base sheet), hot melt coating, calendaring, curtain coating, gravure or pattern coating, spray coating, lamination, pressure feed die coating, knife coating, or by any other suitable technique. It is expressly contemplated that the adhesive layer can be either continuous (such as a uniform layer) or discontinuous (such as strips or bands, dots, or another patterned or random arrangement of discrete adhesive portions).

Although a single layer of adhesive is preferred, one or more additional layers may also be provided. These additional layers may be provided between the adhesive layer and the base sheet (e.g. a primer layer to facilitate bonding between the adhesive layer and the base sheet), or may be applied over the adhesive layer (e.g. an antistatic layer, a low adhesion backsize (LAB), or a detackifying agent), or both. Of course, multiple layers of adhesive are also contemplated.

The particular characteristics of the adhesive layer may be selected to provide appropriate adhesion and release characteristics. In carpet applications, for instance, it may be desirable to provide an adhesive layer that is highly resistant to removal from the surface to which the fastener member is attached. The characteristics of various adhesives are well known, and thus a suitable adhesive may be selected for a particular application.

Dual Purpose Cover Sheet: The dual purpose cover sheet is preferably made of a thin, flexible material having two opposed major surfaces. The first major surface should be suitable for releasable affixation to the engaging members, and the second major surface should be suitable for releasable affixation to the pressure sensitive adhesive layer.

The first major surface of the dual purpose cover sheet may comprise any suitable material that may be releasably affixed to the engaging members. For example, if the engaging members comprise hook structures, the first major surface may include a plurality of loop structures for engagement with the hook structures. Alternatively, the first major surface may comprise a pressure sensitive adhesive to enable adhesive affixation between the cover sheet and the engaging members. The means for releasably affixing the cover sheet to the engaging members may be continuous (a uniform arrangement of loop members, for example) or discontinuous (narrow bands or dots of adhesive, or discrete sections of loop members, for example).

The second major surface of the dual purpose cover sheet is adapted for releasable engagement with the pressure sensitive layer described above. The second major surface may comprise, for example, a release coating such as silicone, an LAB coating (such as that described in U.S. Pat. No. 2,532,011 (Dahlquist et al.)), a plasma coating, a Teflon™ coating, a structured surface, a low energy polymeric surface, fluorocarbon additives, or no coating or structure at all. Again, these and other release features of the second major surface are preferably continuous over the area of the surface.

The dimensions of the dual purpose cover sheet may be selected to suit the particular application. It is preferred that the dual purpose cover sheet be approximately 0.012 to 1.78 mm (0.0005 to 0.070 in) thick, and that the cover sheet be at least as wide as the wider of the pressure sensitive adhesive layer and the plurality of engaging members. For carpet fastening applications, the dual purpose cover sheet is preferably thin, flexible, and tear resistant, so that the cover sheet may be withdrawn through a thin seam between sections of carpet, or along a wall. Furthermore, the adhesion between the cover sheet and the engaging members should be sufficient to insure that the cover sheet is not inadvertently peeled away from the fastener.

Suitable materials for the dual purpose cover sheet may include, but are not limited to, treated or untreated paper (e.g. crepe, rope tissue, repulpable tissue, and kraft), woven fabric (e.g. cotton, rayon, polyester, glass, and nylon), polymeric film (e.g. cellophane, acetate, polyester, vinyl, polyvinyl chloride, polypropylene, polyethylene, and polyimide), nonwoven fabric, foil (e.g. aluminum, stainless steel, and lead), foam (e.g. open and closed cell polyethylene, polyvinyl chloride, polyurethane, and polychloroprene), rubber (e.g. neoprene), metallized film, or combinations or laminates of the foregoing. The cover sheet may also include fibers, fillers, plasticizers, pigments, stabilizers, antioxidants, or mixtures thereof. The cover sheet may additionally bear a primer layer, or be surface treated (e.g. corona discharge treated) to promote adhesion of other constituents to it. Alternatively or additionally, the cover sheet may undergo an orientation processing step to improve its tensile strength characteristics, or be coated with an LAB to prevent bonding or transfer of the adhesive. The LAB may be selected to facilitate removal of the fastener member from the dual purpose cover sheet, and may not be necessary for some adhesives. Also, an antistatic agent may be incorporated into the cover sheet, to prevent accumulation of static electricity on the sheet.

It should be noted that in the preferred embodiment, the characteristics of the dual purpose cover sheet are selected so that the cover sheet remains affixed to the engaging members of the underlying fastener member, rather than to the adhesive layer of the overlying fastener member, when the two are peeled apart. That is, the cover sheet should preferably release from the pressure sensitive adhesive layer and remain attached to the engaging members of the underlying layer of the fastener member. Stated yet another way, the adhesion force between the cover sheet and the layer of pressure sensitive adhesive is preferably less than the affixation force between the cover sheet and the engaging members of an adjacent fastener member. For example, a combination of adhesive and cover sheet may be selected such that the adhesive layer separates from the underlying cover sheet at a force of 24.6 g/cm width (0.138 lb/in width), and the cover sheet separates from the engaging members at a force of 70 g/cm width (0.38 lb/in width). These illustrative disengagement forces were measured on a fastener member of the construction described below in Example One.

The force required to separate the fastener member from the underlying dual purpose cover sheet may also be greater than the force required to separate the cover sheet from the underlying engaging members. In the case of the construction shown in FIG. 3, using a fastener and cover sheet such as that described in Example Five, the force required to separate the fastener member and adhesive layer from the cover sheet was approximately 258 g/cm width (1.44 lbs/in). The force required to separate the cover sheet from the underlying engaging members was approximately 20.9 g/cm width (0.12 lbs/in). However, because the fastener member was wound in a coil, the tensile forces in the cover sheet prevented the cover sheet from being lifted away from the engaging members when the overlying fastener member was peeled from the roll. Thus, the relationship of the two force levels (between fastener member and cover sheet, and between cover sheet and engaging members) may be selected as desired.

Figure 4:
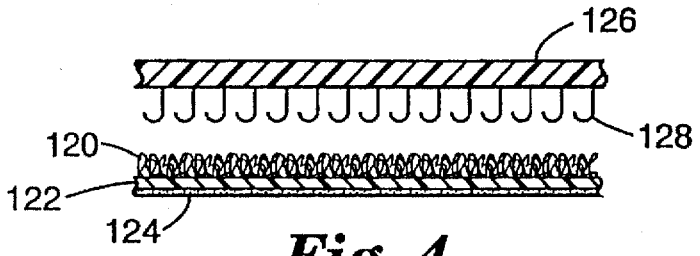
FIGS. 4 through 7 are sectional views of alternate embodiments of the fastener member and dual purpose cover sheet of the present invention.

Various embodiments of the inventive fastener member are illustrated in FIGS. 4 through 7. FIG. 4 shows an embodiment wherein the engaging members comprise a plurality of loop structures 120, which are attached to a base sheet 122 having a layer of pressure sensitive adhesive 124 disposed on the opposite surface. Dual purpose cover sheet 126 includes a plurality of hook structures 128 adapted for releasable interengagement with the loop structures.

Figure 5:
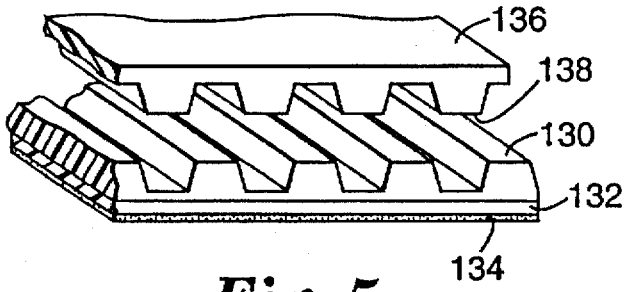

FIG. 5 shows an embodiment wherein the engaging members comprise a structured surface 130, which is attached to a base sheet 132 having a layer of pressure sensitive adhesive 134 disposed on the opposite surface. Although structured surface 130 and base sheet 132 are shown as being discrete components, they could instead be unitary. Dual purpose cover sheet 136 includes an opposed, matching structured surface 138, which is adapted to intermesh with structured surface 130 to secure the cover sheet. The respective structured surfaces may have one of many different patterns, which need not necessarily match each other.

Figure 6:
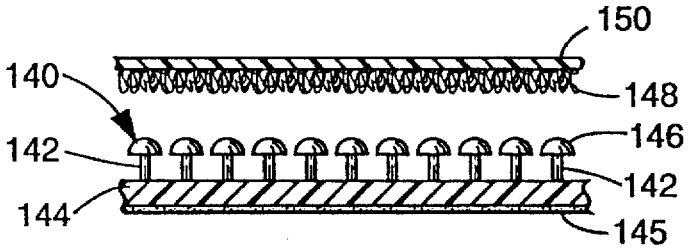
Figure 7:
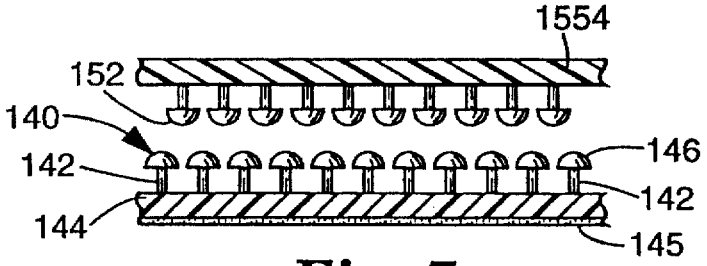

The embodiments shown in FIGS. 6 and 7 include engaging members that are generally shaped as headed stems 140, which each include a stem 142 that projects from base sheet 144, and a head 146 formed at the distal end of stem 142. A layer of pressure sensitive adhesive 145 is provided on the opposite surface of base sheet 144. Heads 146 may be hemispherical, conical, or some other suitable shape, as known in the fastener art. The dual purpose cover sheet may include loop structures 148 anchored to a base sheet 150, as shown in FIG. 6, or mating headed stems 152 anchored to a base sheet 154, as shown in FIG. 7.

The dual purpose cover sheet of the present invention has primary, although not exclusive, applicability to fastener members provided in roll form, as shown in FIG. 3. In the context of the embodiment shown in FIG. 3, a first fastener member and a second fastener member may be spaced portions of a unitary, longitudinally extending fastener member, rather than individual, discrete fastener members. Other fastener arrangements, such as the stack arrangement shown in FIG. 8, with the dual purpose cover sheet 160 disposed between adjacent fastener members 162, are also included within the scope of the present invention.

The operation of the present invention will be better understood with reference to the following Examples.

EXAMPLE ONE

Figure 9:
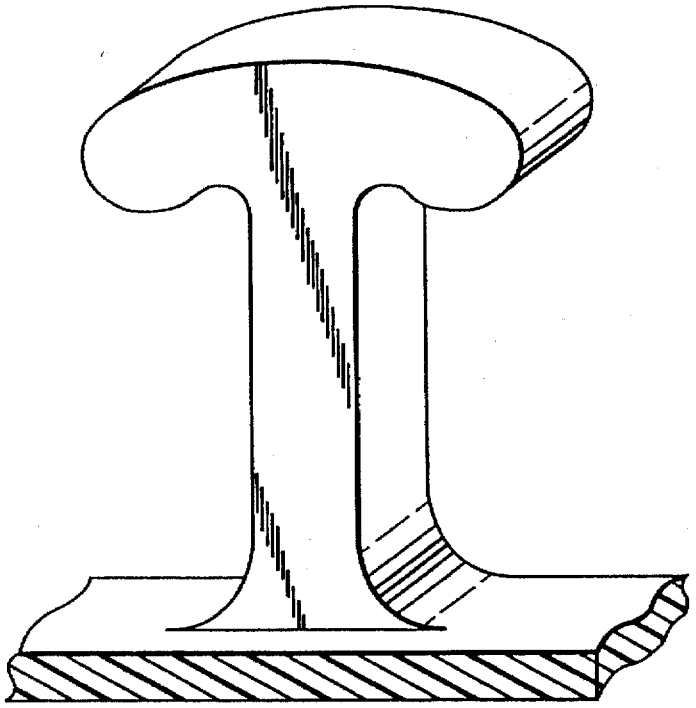
Fig. 9 PRIOR ART
FIG. 9 is a perspective view of an exemplary engaging member for use with the present invention.

A fastener member was produced by the process described in U.S. Pat. No. 4,894,060 (Nestegard). Both the base sheet and the engaging members of the fastener member comprised a polypropylene copolymer resin, available from the Shell Chemical Company of Houston, Tex., under the designation SRD 6-166. The base sheet measured approximately 100 mm (4 in) wide, and 0.18 mm (0.007 in) thick, and included a plurality of T-shaped engaging members that projected from the base sheet. Each T-shaped engaging member, an example of which is shown in FIG. 9, measured approximately 0.254 mm (0.010 in) high, and the engaging members were regularly spaced at a density of approximately 66 per square cm (425 per square inch). A layer of hot melt coated pressure sensitive adhesive approximately 0.254 mm (0.010 in) thick was extruded by a single screw extruder onto the base sheet on the major surface opposite the engaging members, at a temperature of approximately 154.5° C. (310° F.). The hot melt adhesive used was a Kraton™ styrene-butadiene-styrene rubber-based adhesive, comprising the following elements:

| Material | % (by weight) | Available Through |
|---|---|---|
| Kraton ™ 1118 rubber | 19.8% | Shell Chemical Co. (Houston, TX) |
| Solprene ™ 1205 Rubber | 20.8% | Housemex, Inc. (Houston, TX) |
| Piccolyte ™ A135 Resin | 48.3% | Hercules, Inc. (Brunswick, GA) |
| Shellflex ™ 371 Oil | 10.1% | Shell Chemical Co. (Houston, TX) |
| Irganox ™ 1076 Antioxidant | 1.0% | Ciba Giegy Indus. Chem. (McIntosh, TX) |

The adhesive layer was allowed to cool at room temperature. The dual purpose cover sheet was provided, and was applied to the engaging members. The cover sheet was made of cast polypropylene and coated with a rubber based adhesive on one side, for affixation to the engaging members, and a silicone release agent on the other side, to permit releasable engagement with the pressure sensitive adhesive layer. The cover sheet measured approximately 13.7 cm (4.5 in) wide, and 0.178 mm (0.007 in) thick. A cover sheet of this type is available from the Minnesota Mining and Manufacturing Company under the designation KR-0261.

The fastener member was wound on a core having a silicone release agent on the outer cylindrical surface, such that the adhesive layer adhered the fastener member to the core. As the fastener member was wound on the core, the cover sheet received the pressure sensitive layer of the fastener member above it, as shown generally in FIG. 3. To unwind the roll, the fastener member including the cover sheet was peeled from the core and applied to a surface. To secure an object (such as another fastener member, or a piece of carpet, for example) to the fastener member mounted on the surface, the cover sheet was removed to expose the engaging members. The object could then be releasably attached to the engaging members. The foregoing fastener arrangement was found to perform satisfactorily.

EXAMPLE TWO

A fastener member was prepared as described above with reference to Example One, with the following exceptions. The dual purpose cover sheet number KR-0261 was replaced by a dual purpose cover sheet including a base sheet having protruding nylon tricot loop members, available from the Guilford Mills Co. of Greensboro, N.C., under the designation #31835. The opposite (back) surface of the cover sheet was corona treated with a 400 watt corona treatment station (operating at 13.5 amps, 75 volts, and a frequency of 27 kHz) while travelling at 0.25 m/s (50 ft/min). Following the corona treatment step, the back surface of the cover sheet was coated with approximately 0.05 grains of silicone per 15,000 $mm^2$ (24 $in^2$), to facilitate release of an overlying adhesive layer. The silicone was available from the Dow Chemical Company of Midland, Mich., under the designations #7850 (97.2% by weight) and #7488 (2.8% by weight). The silicone was cured at approximately 107° C. (225° F.) for 15 seconds.

The cover sheet thus prepared was applied to the fastener member described in Example One, with the loop members of the cover sheet engaging with the engaging members of the fastener member. The fastener member and dual purpose cover sheet were wound on a core in the manner described in Example One, and were aged at room temperature for three weeks. The fastener member was found to perform satisfactorily.

It should be noted that the foregoing construction may not be suitable for all applications, because the cover sheet is highly permeable, which allows air flow past the adhesive layer of the fastener member. This air flow can cause some adhesives to lose tack, as is known in the art. Thus, adhesives used with the foregoing construction should be selected to be resistant to the potentially deleterious effects of air flow.

EXAMPLE THREE

A fastener member was prepared as described above with reference to Example One, with the following exceptions. The KR-0261 dual purpose cover sheet was replaced by a biaxially oriented polypropylene film tape cover sheet. The tape cover sheet was prepared with a pressure sensitive adhesive on one surface, for application to the engaging members, and with an LAB coat on the opposite surface, for application to the pressure sensitive adhesive layer of an overlying fastener member. A tape of such a construction is available from the Minnesota Mining and Manufacturing Company, under the designation Highland™ Brand Utility Box Sealing Tape #371.

The adhesive side of the tape cover sheet was applied to the uppermost portions of the engaging members, and thus the LAB side was presented for receipt of the pressure sensitive adhesive layer of an overlying fastener member. The fastener member and the tape cover sheet were thereafter wound on a core in the manner described in Example One, and was aged for one week at room temperature. The fastener member was difficult to unwind, because of the high adhesion between the pressure sensitive adhesive layer of the fastener member and the LAB side of the tape cover sheet. It is believed that the use of a less aggressive adhesive on the fastener member, or a more effective LAB on the cover sheet, would result in better unwinding performance.

EXAMPLE FOUR

A fastener member was prepared as described above with reference to Example One, with the following exceptions. The KR-0261 dual purpose cover sheet was replaced by a base sheet having loop members, comprising a polypropylene copolymer sheet with polypropylene loop members projecting therefrom. The overall thickness of the cover sheet was 1.65 mm (0.065 in), including a base sheet measuring approximately 0.051 mm (0.002 in) thick and loop members measuring approximately 1.6 mm (0.063 in) high. The density of the loop members was approximately 33 $g/m^2$ (0.062 $lb/yd^2$). A product of this general type is particularly described in PCT Patent Publication No. 92/01401.

The surface of the cover sheet opposite the loop members (the back surface) was corona treated with a 400 watt corona treatment station (operating at 13.5 amps, 75 volts, and a frequency of 27 kHz) while travelling at 0.25 m/s (50 ft/min). Following the corona treatment step, the back surface was coated with approximately 0.022 grains of silicone per 15,000 $mm^2$ (24 $in^2$), to facilitate release of an overlying adhesive layer. The silicone was available from the Dow Chemical Company under the designations #7850 (97.2% by weight) and #7488 (2.8% by weight). The silicone was cured at approximately 107° C. (225° F.) for 15 seconds.

The cover sheet thus prepared was applied to the fastener member described in Example One, with the loop members of the cover sheet engaging with the engaging members of the fastener member. The fastener member and dual purpose cover sheet were wound on a core in the manner described in Example One, and were aged at room temperature for three weeks. The fastener member was found to perform satisfactorily.

EXAMPLE FIVE

A fastener member was prepared as described above with reference to Example One, with the following exceptions. The KR-0261 dual purpose cover sheet was replaced by a biaxially oriented polyester film tape cover sheet. The tape cover sheet was prepared with a pressure sensitive adhesive on one surface, for application to the engaging members, and with an LAB coat on the opposite surface, for application to the pressure sensitive adhesive layer of an overlying fastener member. A tape of such a construction is available from the Minnesota Mining and Manufacturing Company, under the designation #353.

The adhesive side of the tape cover sheet was applied to the uppermost portions of the engaging members, and thus the LAB side was presented for receipt of the pressure sensitive adhesive layer of an overlying fastener member. The fastener member and the tape cover sheet were thereafter wound on a core in the manner described in Example One, and was aged for one week at room temperature. The fastener member was difficult to unwind, because of the high adhesion between the pressure sensitive adhesive layer of the fastener member and the LAB side of the tape cover sheet. It is believed that the use of a less aggressive adhesive on the fastener member, or a more effective LAB on the cover sheet, would result in better unwinding performance.

The present invention has now been described with reference to several embodiments thereof. It will be apparent to those skilled in the art that many changes can be made in the embodiments described without departing from the scope of the invention. Thus, the scope of the present invention should not be limited to the structures described herein, but rather by the structures described by the language of the claims, and the equivalents of those structures.

We claim:

1. A fastener arrangement, comprising:

a) a first fastener member, comprising:

i) a base sheet having a first major surface; and ii) a plurality of engaging members attached to and projecting from the first major surface;

b) a dual purpose cover sheet having first and second major surfaces, the first major surface including means for releasable affixation to the engaging members of the first fastener member, to affix the cover sheet to the first fastener member; and c) a second fastener member overlying said first fastener member, comprising:

i) a base sheet having first and second major surfaces;

ii) a multiplicity of engaging members attached to and projecting from the first major surface;

iii) a layer of pressure sensitive adhesive interposed between the second major surface of said base sheet and said second major surface of said cover sheet, for releasably affixing the second fastener member to said cover sheet.

2. The fastener arrangement of claim 1, wherein said first and second fastener members and said cover sheet are wound on core, and said first and second fastener members are spaced portions of a unitary, longitudinally extending fastener member.

3. The fastener arrangement of claim 1, wherein said arrangement is a stack of individual fastener members having alternating layers of fastener members and dual purpose cover sheets.

4. The fastener arrangement of claim 1, wherein the pressure sensitive adhesive is selected from the group consisting of styrene-butadiene-styrene rubber adhesives, styrene-isoprene-styrene rubber adhesives, and acrylic adhesives.

5. The fastener arrangement of claim 1, wherein the engaging members in element (a) comprise a plurality of hook members, and the means for releasable affixation in element (b) comprises a plurality of loop members and wherein the affixation force between said first fastener and said cover sheet is greater than the affixation force between said second fastener member and said cover sheet.

6. The fastener arrangement of claim 1, wherein the engaging members in element (a) a plurality of loop members, and for releasable affixation in element (b) comprises a plurality of hook members and wherein the affixation force between said first fastener and said cover sheet is greater than the affixation force between said second fastener member and said cover sheet.

7. The fastener arrangement of claim 1, wherein the dual purpose cover sheet comprises polypropylene.

8. The fastener arrangement of claim 1, where in the base sheet comprises fibers selected from a group consisting of woven fibers and knitted fibers.

9. The fastener arrangement of claim 1, wherein the base sheet is formed from an extruded polymer.

10. The fastener arrangement of claim 1, wherein the engaging members of the first fastener member comprise a first structure surface, and the means for releasable affixation to the engaging members comprises a second structured surface adapted for intermeshing engagement with the first structured surface, wherein said structured surfaces of said first fastener member and said cover sheet each including a plurality of solid tapered elements, each element having at least one side inclined relative to a common plane in each of said first fastener member and said cover sheet at an angle sufficient to form a taper so that said element of said first fastener member may mesh with said elements of said cover sheet when brought into contact with one another and said cover sheet may be releasably affixed to said first fastener member at least partially because of the frictional force of adherence of said contacting sides of said elements of said first fastener member and said elements of said cover sheet and wherein the tangent of the half angle of the tapered sides of the element is no greater than the coefficient of friction of the material of the contacting surfaces.

11. The fastener arrangement of claim 1, wherein the dual purpose cover sheet comprises tape having a layer of pressure sensitive adhesive on one major surface thereof, whereby the pressure sensitive adhesive layer of the tape affixes the cover sheet to the engaging members.

12. The fastener arrangement of claim 1, wherein said second major surface of the dual purpose cover sheet includes means for facilitating release of the pressure sensitive adhesive layer of the second fastener member.

13. The fastener arrangement of claim 12, wherein said release means comprises a surface selected from a group consisting of a low adhesion backsize layer, a silicone layer, a Teflon™ layer, and a low energy surface layer.

14. The fastener arrangement of claim 13, wherein said release means is selected to enable the second fastener member to be removed from the fastener arrangement while the dual purpose cover sheet remains affixed to the engaging members of the first fastener member.

15. The fastener arrangement of claim 1, wherein said means for releasable affixation of the first fastener member to said cover sheet includes an adhesive coated on said first major surface of said cover sheet.

16. The fastener arrangement of claim 15, whereto said adhesive coated on said first major surface of said cover sheet is a pressure sensitive adhesive.

17. The fastener arrangement of claim 15, wherein said adhesive coated on said first major surface of said cover sheet is coated substantially continuously over said first major surface.

18. The fastener arrangement of claim 1, wherein said adhesive layer releasably adheres the second fastener member directly to the second major surface of said cover sheet.

19. A fastener arrangement, comprising:

a first fastener member, comprising a base sheet having a first major surface and a plurality of engaging members attached to and projecting from the first major surface;

a dual purpose cover sheet having first and second major surfaces, the first major surface including means for releasable affixation to the engaging members of the first fastener member to affix the cover sheet to the first fastener member, and the second major surface including means for facilitating release of a pressure sensitive adhesive layer; and a second fastener member overlying said first fastener member, comprising a base sheet having first and second major surfaces, a multiplicity of engaging members attached to and projecting from the first major surface, and a layer of pressure sensitive adhesive interposed between the second major surface of said base sheet and said second major surface of said cover sheet for releasably affixing the second fastener member to said cover sheet.

* * * * *

UNITED STATES PATENT AND TRADEMARK OFFICE

CERTIFICATE OF CORRECTION

PATENT NO.: 5,691,027

DATED: November 25, 1997

INVENTOR(S): Carey J. Eckhardt and Bradley D. Zinke

It is certified that error appears in the above-identified patent and that said Letters Patent is hereby corrected as shown below:

Col. 11, line 46 after "(a)" insert --comprise--.

Col. 11, line 47 after "members, and" insert --the means--.

Col. 12, line 35 "whereto" should read --wherein--.

Signed and Sealed this

Eighteenth Day of August, 1998

Bruce Lehman

*Attest:*

BRUCE LEHMAN

*Attesting Officer*

*Commissioner of Patents and Trademarks*